United States Patent [19]

Stribiak

[11] Patent Number: 4,905,829

[45] Date of Patent: Mar. 6, 1990

[54] TOOL CONTAINMENT AND DISPENSING APPARATUS

[75] Inventor: John J. Stribiak, Homewood, Ill.

[73] Assignee: Precision Carbide Tool Co., Inc., Niles, Ill.

[21] Appl. No.: 366,467

[22] Filed: Jun. 15, 1989

[51] Int. Cl.[4] ..... B65D 85/24

[52] U.S. Cl. ..... 206/349; 206/459; 206/807

[58] Field of Search ..... 206/349, 459, 807, 368, 206/207, 249

[56] References Cited

U.S. PATENT DOCUMENTS 4,811,843 3/1989 Stribiak ..... 206/349

FOREIGN PATENT DOCUMENTS 963074 6/1950 France ..... 206/349

*Primary Examiner*—William Price

*Attorney, Agent, or Firm*—Dick and Harris

[57] ABSTRACT

A tool containment and dispensing apparatus for facilitated insertion and removal of a rotary cutting tool into and out of conventional drilling equipment, without user handling, as well as for safe storing and transporting of such tools. A tool carriage element reciprocates the tool within an apparatus housing, between a partially exposed extended position and a fully enclosed retracted position. The tool carriage is configured with a tool retainment channel and a tool tip seating element to protect the tool from contact with the internal area of the housing and to effectively secure and align the rotary cutting tool with the housing's release aperture. A resealable end cap is provided to completely seal the tool containment and dispensing apparatus from liquid and foreign objects.

16 Claims, 3 Drawing Sheets

TOOL CONTAINMENT AND DISPENSING APPARATUS

BACKGROUND OF THE INVENTION

The present invention relates in general to tool protection and enclosure devices and, in particular, to a tool containment and dispensing apparatus which, through reciprocation, receives, maintains and dispenses a rotary cutting tool from within an internal chamber of a protective housing, thereby protecting the rotary cutting tool from potentially damaging contact with external objects during handling, storing and transportation of same.

For many years, industry has utilized tool containment elements for storing and handling rotary cutting tools in a relatively protective manner. New diamond crystal rotary cutting tools, for example, can cost in excess of several hundred dollars a piece. Accordingly, for economic reasons alone, adequate protection against potential damage, and thus replacement of such a costly rotary cutting tool is highly desirable. While several containment devices have typically provided for an enclosed region for the rotary cutting tools stored therewithin, few, if any, have comprised a dispensing device which enables a user to alternatively store, remove or expose a portion of the rotary cutting tool from within the containment device itself, without physical handling of the tool itself. In spite of the existence of tool containment devices in the industry, few, if any, prior art devices utilize a separate reciprocating tool carriage within an apparatus housing, which enables a user to extend the rotary cutting tool out of the containment housing and into a drilling machine, and then, completely back into the containment apparatus, after the drilling operation is completed, all without the necessity to physically handle the tool itself.

It is thus an object of the present invention to provide a tool containment and dispensing apparatus which can, through reciprocation, expose and then retract a rotary cutting tool through the use of a prompting element so as to eliminate the necessity to physically handle the tool during insertion and removal from a conventional drilling machine.

Another object of the present invention is to provide a tool containment and dispensing apparatus which comprises an internal tool carriage device, which concentrically aligns the rotary cutting tool in relation to an aperture through which the rotary cutting tool is to pass through when extended or retracted.

It is further an object of the present invention to provide a tool containment and dispensing apparatus which significantly reduces the risk of damage to the rotary cutting tool shank, flute and tip during storage, transportation and handling, as well as during insertion and removal, while permitting the realignment and secure positioning of the rotary cutting tool back into the tool containment and dispensing apparatus--for further storage, transporting and dispensing.

It is also an object of the present invention to provide a tool containment and dispensing apparatus which is efficiently designed and inexpensively constructed so as to minimize manufacturing costs associated therewith.

These and other objects of the invention will become apparent in light of the present specification and drawings.

SUMMARY OF THE INVENTION

The present invention relates to a tool containment and dispensing apparatus for enclosing and protecting a rotary cutting tool, as well as for safely handling, storing and transporting such a rotary cutting tool.

The tool containment and dispensing apparatus includes an apparatus housing which is described by a front portion and a back portion positioned opposite to the front portion, a top end and a bottom end positioned opposite to the top end, and a first side and a second side, positioned opposite to the first side. As constructed, this housing describes an internal chamber which serves to accept and enclose a rotary cutting tool therewithin. An aperture is positioned at the top end of the housing means, which is of a size greater than the diameter of the rotary cutting tool, to enable the insertion and removal of the rotary cutting tool into and out of the internal chamber of the housing means.

The tool containment and dispensing apparatus additionally includes tool carriage means which operably and releasably receives and maintains the rotary cutting tool. The tool carriage means has a top end, a bottom end opposite the top end, and a pair of sides, and is slidably positioned for operable reciprocation within the internal chamber of the housing means. Such slidable positioning can range from an extended position, which is proximate to the top end of the housing means, to a retracted position, which is proximate to the bottom end of the housing means. Reciprocation of the tool carriage means enables reorientation of the rotary cutting tool, which is maintained therewithin, from a partially exposed extended position to a fully enclosed retracted position within the internal chamber of the housing means. Furthermore, the actual reciprocation of the tool carriage means, and, in turn, the rotary cutting tool maintained by it, occurs substantially along the longitudinal axis of the housing means.

The preferred embodiment of the tool containment and dispensing apparatus includes tool retention means, which are operably positioned within the tool carriage means for telescopically and releasably accepting, maintaining and releasing the rotary cutting tool towards releasable maintenance within the tool carriage means. The tool retention means actually facilitates proper positioning of the rotary cutting tool in operable alignment with the aperture means. Accordingly, the rotary cutting tool can effectively pass into or out of the internal chamber of the housing means through the aperture means located at the top of the housing means, without running the risk of obstruction.

The tool carriage means further includes reciprocation prompting means. The reciprocation prompting means are operably attached to the tool carriage means for exposure on the outside of the housing means, and accordingly, on the outside of the internal chamber of the housing means. Such positioning facilitates manual prompting of the slidable reciprocation of the tool carriage means, and, in turn, the rotary cutting tool, between the tool's partially exposed extended position, and its fully enclosed retracted position within the internal chamber of the housing means.

In the preferred embodiment of the invention, the tool containment and dispensing apparatus further includes slot means which are formed within the housing means. The slot means have an upper first end and a lower second end which is positioned opposite to the first end. The slot means enables the exposure of the reciprocation prompting means. The slot means are operably positioned on either the front, back, top, bottom, first side or second side of the housing means. Or, alternatively, it can be positioned at more than one location on the housing means. The reciprocation prompting means extends from the tool carriage means, through the slot means, so as to be exposed along the outer periphery of the housing means to enable the manual prompting or reciprocation of the tool carriage means, and, in turn, the rotary cutting tool, into its alternative partially exposed extended and fully enclosed retracted positions. Furthermore, the reciprocation prompting means comprises a reciprocating dispenser switch element for manually reciprocating the tool carriage means.

The slot means additionally includes reciprocating limit means which are integrally constructed within the housing means. These reciprocating limit means are utilized to restrict the extent of retraction and extension of the reciprocation prompting means to, in turn, restrict the motion of the tool carriage means and rotary cutting tool between predetermined limit positions. The reciprocating limit means comprises an upper stop element which is operably positioned adjacent to the upper first end of the slot means, and a lower stop element operably positioned adjacent to the lower second end of the slot means.

In the preferred embodiment, the slot means additionally includes at the upper first end and lower second end of the slot means, reciprocation locking means which are operably positioned for releasably securing the tool carriage means, and, in turn, the rotary cutting tool, into its alternative partially exposed extended position as well as into its fully enclosed retracted position.

The reciprocating dispenser switch element is preferably constructed with a knurled surface to facilitate ease in manual manipulation of the reciprocation prompting means. Such manipulation enables the tool carriage means, as well as the rotary cutting tool, to be positioned between an alternative partially exposed extended position and a fully enclosed retracted position, with little difficulty or potential for slippage, while manually applying upward or downward pressure upon the reciprocation prompting means.

In this embodiment, the tool containment and dispensing apparatus further comprises replaceable end cap means having a top end and a bottom end, positioned opposite to the top end. The bottom end is removably attachable to the top end of the housing means, and serves as a sealing cover for enclosing and protecting the rotary cutting tool positioned within the housing means. The replaceable end cap means additionally serves to seal the internal chamber of the housing means from any foreign materials and liquids which may otherwise enter therein. Accordingly, the end cap means further isolates and protects the rotary cutting tool within the housing means, during the handling, storage and transportation of the tool containment and dispensing apparatus.

The top end of the housing means includes a plurality of end cap attachment apertures. These apertures cooperate with mated fastening elements which are positioned on the bottom side of the replaceable end cap means, and which are aligned with these end cap attachment apertures, to provide aligned cooperation toward releasable securement of the replaceable end cap means to the top end of the housing means. The mated fastening means of the replaceable end cap means comprise biased detents operably attached to its bottom end. These detents cooperate with the end cap attachment apertures at the top end of the housing means for releasable securement therebetween.

In the preferred embodiment of the invention, the housing means further includes tracking means which are operably positioned along the interior side of at least one of the front and back portions of the housing means, within the internal chamber. The tracking means serve to effectively guide the tool carriage means during slidable reciprocation of same, so as to facilitate aligned movement of the tool carriage means, and, in turn, to keep the rotary cutting tool maintained in an operably aligned position with respect to the aperture means. This operable alignment facilitates the passage of the rotary cutting tool into and out of the aperture means, and in turn, into and out of the internal chamber of the housing means, without obstruction therebetween.

The tool retention means comprises a resilient tool positioning channel. This channel is concentrically positioned within the tool carriage means for operably and releasably receiving, guiding and maintaining the rotary cutting tool in its substantially aligned position relative to the aperture located at the top of the housing means. Furthermore, the tool retention means includes tapered acceptance edges which are operably positioned at the top end of the tool carriage means. These tapered acceptance edges facilitate the insertion of the rotary cutting tool into and out of the tool positioning channel means.

In the preferred embodiment of the invention, the tool carriage means further includes tool tip seating means operably located proximate to the bottom end of the tool carriage means, for effectively locating, maintaining and accordingly protecting the cutting tip of the rotary cutting tool. The tool tip seating means is resiliently positioned in the tool carriage to absorb shock to which the apparatus may be exposed.

The tool carriage means itself is constructed of a substantially resilient elastomeric material. This resilient material, such as nylon, is thereby effectively capable of absorbing shock transmitted to the rotary cutting tool while at the same time reducing friction during reciprocation of the tool carriage means within the housing means.

Preferably, the tool containment and dispensing apparatus further includes one or more label receiving areas which are operably positioned along at least one exposed aligned surface of both the housing means, and the replaceable end cap means, for operable cooperation with one or more labels. At least one of the labels which cooperates with one of the one or more label receiving areas is capable of attachment to at least a portion of the aligned surface of both the housing means, and the replaceable end cap means, so as to form a seal therebetween. Such a label may be scored at a position adjacent to the bottom end of the replaceable end cap means, and the top end of the housing means. Such scoring enables the label to break away when the replaceable end cap means is removed from the top of the housing means. Accordingly, when one or more of these labels has been torn, a user will be alerted that the tool containment and dispensing apparatus has been unsealed.

In the preferred embodiment of the invention, the tool containment and dispensing apparatus further comprises indicia means which are operably and visibly affixed to at least a portion of the housing means or the replaceable end cap means. These indicia means serve to identify the structural specifications of the rotary cutting tool which is contained within the housing means, as well as to additionally reveal any maintenance data which may be associated with the tool itself--data such as tool resharpening information.

DETAILED DESCRIPTION OF THE DRAWINGS

Figure 1:
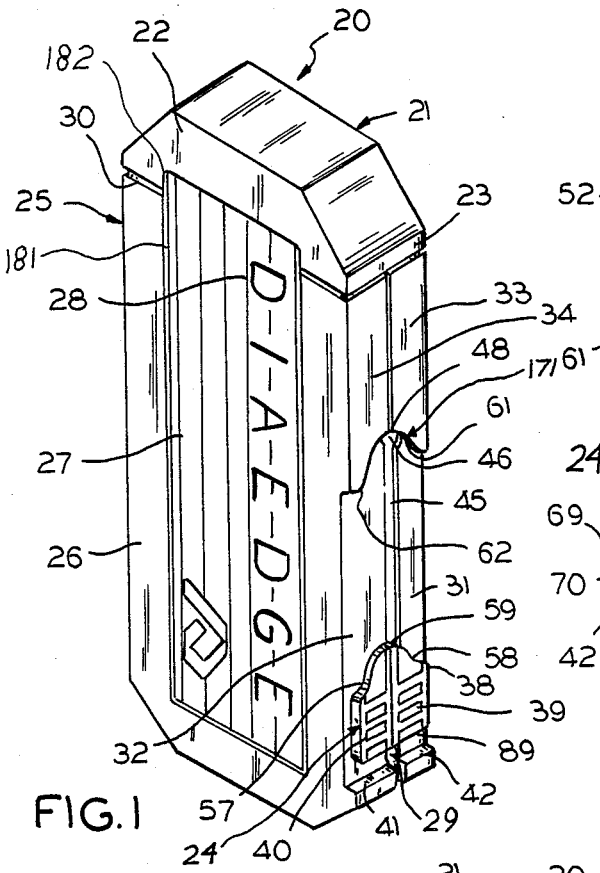
FIG. 1 of the drawings is a perspective view of the tool containment and dispensing apparatus, showing the positioning of reciprocation prompting means when the rotary cutting tool is in a retracted enclosed position, as well as showing the untorn break-away label on the front cover of the housing means and end cap.

While this invention is susceptible of embodiment in many different forms, there is shown in the drawings and will herein be described in detail, one specific embodiment, with the understanding that the present disclosure is to be considered as an exemplification of the principles of the invention and is not intended to limit the invention to the embodiment illustrated.

Figure 3:
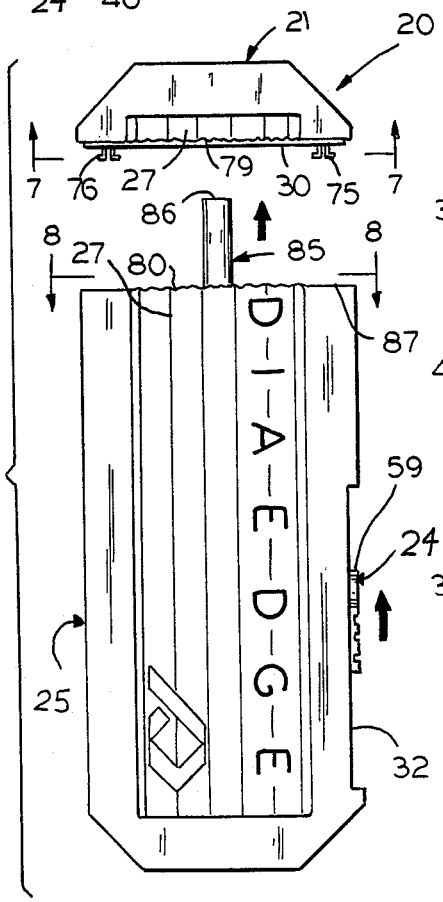
FIG. 3 of the drawings is an elevated exploded front view of the apparatus showing the replaceable end cap after it has been removed from the apparatus, together with a torn breakaway label, and also showing partial exposure of the rotary cutting tool shank after it has been prompted in the direction of the arrow, as well as the biased detents used to secure the replaceable end cap to the top of the apparatus housing means.

Tool containment and dispensing apparatus 20 is shown in FIG. 1 as including end cap means 21, reciprocation prompting means 24, and housing means 25. The housing means itself is made up of two substantially symmetrical housing halves. First housing half 34 and second housing half 33 are operably attached to each other in a removably secured fashion when apparatus 20 is completely assembled. Apparatus 20 also includes labels, such as label 27, which bears indicia, such as indicia 28, which can include the specifications for size, type, etc., of the rotary cutting tool (not shown) contained therein. As is shown, label 27 is applied to front side 26 of housing means 25, in label recess 181, to extend onto at least a portion of front side 22 of removable end cap 21, in a corresponding recess field 182. Accordingly, a seal is thereby formed between the end cap and the housing. As long as the seal has not been broken, a user can be sure that tool 85, as shown in FIG. 3, has not been used or removed. In addition, edge 30 of end cap 21 abuts with the top end of housing means 25 so as to completely seat thereon.

Figure 2:
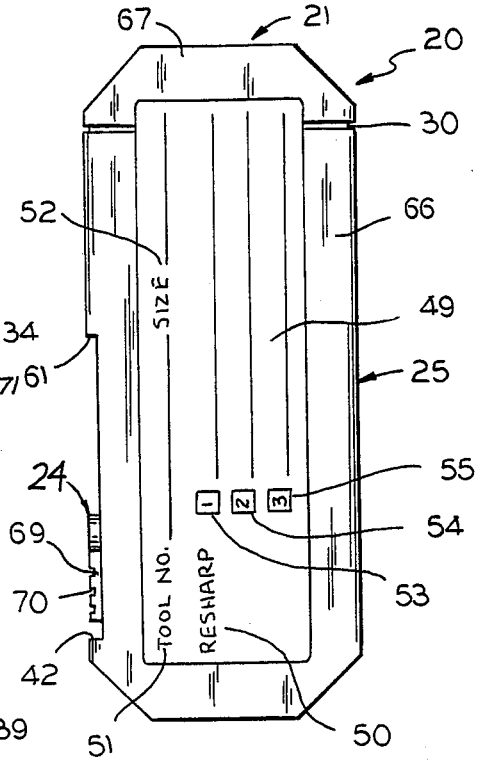
FIG. 2 of the drawings is an elevated rear view of the tool containment and dispensing apparatus of FIG. 1, showing an un-opened apparatus, and, particularly, revealing a label which includes indicia for structural specifications, as well as any maintenance data relative to the rotary cutting tool itself.
Figure 4:
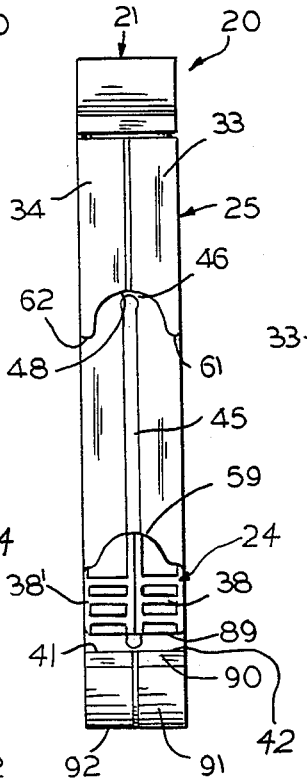
FIG. 4 of the drawings is an elevated side view of the apparatus of FIG. 1, particularly showing the slot means integrally formed into the housing means positioned behind the reciprocation prompting means.
Figure 10:
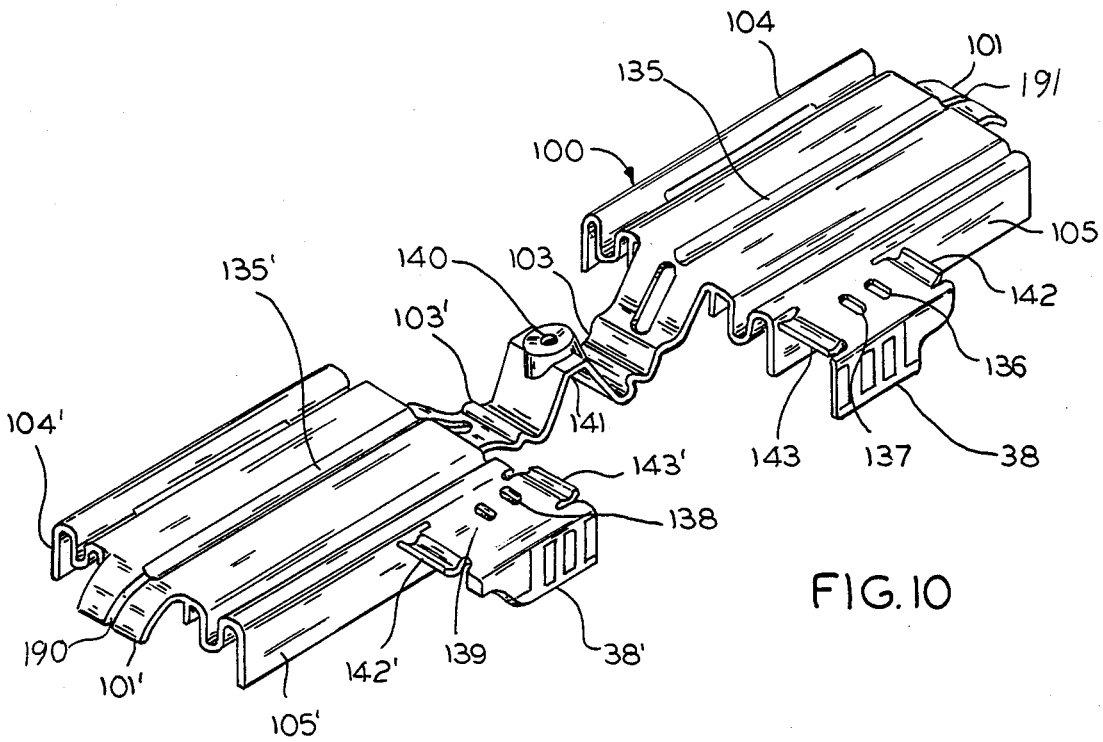
FIG. 10 of the drawings is an exploded perspective view of the tool carriage means, showing, in particular, the connecting attachment elements of the reciprocation prompting means, the contoured channels which conform substantially around the rotary cutting tool to accept same upon insertion and the resilient configuration of the tool tip seating means of the tool carriage means.

Reciprocation prompting means 24 is comprised of a first half 38, and a second half 38,, as shown in FIG. 4, and is constructed with a knurled surface consisting of raised portions, such as raised portions 39 and 40, and recessed portions, such as recessed portions 69 and 70, as shown in FIG. 2. Additionally, reciprocation prompting means 24 is configured so as to have a substantially flat bottom 89, and a contoured top surface 59 having contours 57 and 58. When reciprocation prompting means 24 is manipulated upwardly between guide halves 31 and 32 in slot 45, it prompts the tool carriage means 100 (and rotary cutting tool 85) into an extended position. In this extended position contours 57–59 will abut with aligned contours 62, 48 and 61, respectively, at top reciprocating limit means 171. Bottom reciprocating limit means 41–42, located adjacent to bottom 89 of reciprocation prompting means 24, precludes over-retraction of reciprocation prompting means 24 when retracting rotary cutting tool 85, as shown in FIG. 3, back into its stored position within apparatus 20. Furthermore, slot means 45 enables reciprocation prompting means 24 to operably emanate from tool carriage means 100, as shown in FIG. 10, so as to enable slidable reciprocation of same within housing means 25, and, in turn, to enable rotary cutting tool 85, as shown in FIG. 3, to be maneuvered into its exposed or retracted position. Upper and lower tool retraction locking means 46 and 29, respectively, are located at the top and bottom of slot means 45. These locking means serve to secure reciprocation prompting means 24, and, in turn, tool carriage means 100 into a fully extended or fully retracted position. Also shown in FIG. 1 is side panel 23 of end cap 21, which will also accept application of a sealing label.

Tool containment and dispensing apparatus 20 is shown in FIG. 2, as comprising back side 66 of housing means 25, as well as back side 67 of end cap 21. Label 49 is positioned relative to the longitudinal axis of apparatus 20, to include indicia means, such as indicia means 50 through 55, which may be used to visibly display the structural specifications of the respective rotary cutting tool, such as rotary cutting tool 85, as shown in FIG. 3, which is intended to be stored in apparatus 20, as well as any maintenance data, such as sharpening information, relating to the cutting portion of the tool.

Recessed portions 69 and 70 of reciprocation prompting means 24 are shown located between raised portions, such as raised portions 40 and 39, as shown in FIG. 1. Such raised-and recessed surfaces provide a knurled surface which facilitates ease in manual manipulation of reciprocation prompting means 24. Top edge of bottom reciprocating limit means 42, and bottom edge 61 of top reciprocating limit means 171, as shown in FIG. 1, are used to restrict movement of reciprocation prompting means 24 between its extended or fully retracted positions. Also shown in FIG. 2 is abutment edge 30 of end cap 21.

The present tool containment and dispensing apparatus 20 is shown in FIG. 3 after end cap 21 has been removed from housing means 25. As this occurs, at least a portion of label 27 is torn. Accordingly, a tear, such as tear 79–80, occurs at the point where the label is actually ripped. Visual observance of such a jagged label edge 79–80 will thereby alert a user that the tool, such as tool 85, may have been previously used, or, at the minimum, that apparatus 20 has been previously unsealed.

Once end cap 21 is removed from housing means 25, rotary cutting tool 85 can be prompted into a substantially exposed position merely by applying upward pressure upon reciprocation prompting means 24, in the direction of the arrow shown in FIG. 3, until top portion 59 of reciprocation prompting means 24 abuts with reciprocating limit means 48, as shown in FIG. 1. Upon such abutment, the shank of tool 85 will be extended into an exposed position with respect to the apparatus housing. Vertical movement of reciprocation prompting means 24 is accomplished by sliding these reciprocation prompting means within slot 45 formed by guides 31 and 32, as shown in FIG. 1. Also shown in FIG. 3, are detents 75 and 76 of end cap 21. These detents are of a biased construction and are used to secure end cap 21 onto housing means 25 through receipt in housing apertures 115 and 116 shown in FIG. 8. Top surface 87 of housing means 25 cooperates with edge 30 upon attachment of end cap 21. Shank end 86 of rotary cutting tool 85 is also shown in FIG. 3.

In FIG. 4, tool containment and dispensing apparatus 20 is shown with reciprocation prompting means 24, in its retracted position, so that end cap 21 can be operably attached to housing means 25. As can be seen, prompting means halves 38 and 38, are operably positioned so that bottom 89 of reciprocation prompting means 24 is adjacent to the top of bottom reciprocating limit means 41–42. As a result, top contour 59 of reciprocation prompting means 24 is removed from contact with upper reciprocating limit means 171. Also shown in FIG. 4 are housing halves 33 and 34, slot means 45 and housing bottom surfaces 91 and 92 emanating from side panel 90.

Figure 5:
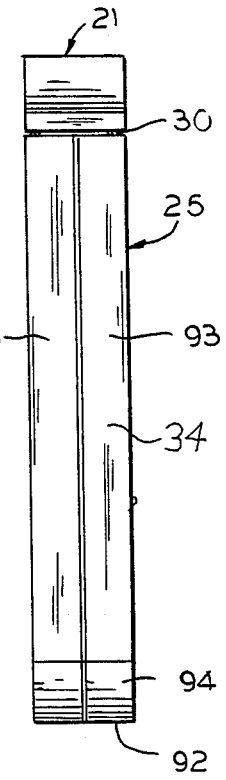
FIG. 5 of the drawings is another elevated side view of the opposite side of the tool containment and dispensing apparatus of FIG. 1.

Back side 93 of housing means 25 is shown in FIG. 5, together with abutment edge 30 of end cap 21, which abuts with top surface 87 of housing means 25. Also shown in FIG. 5 are first and second halves 33 and 34 of housing means 25, and oblique bottom portions 94 and 92 of housing means 25.

Figure 6:
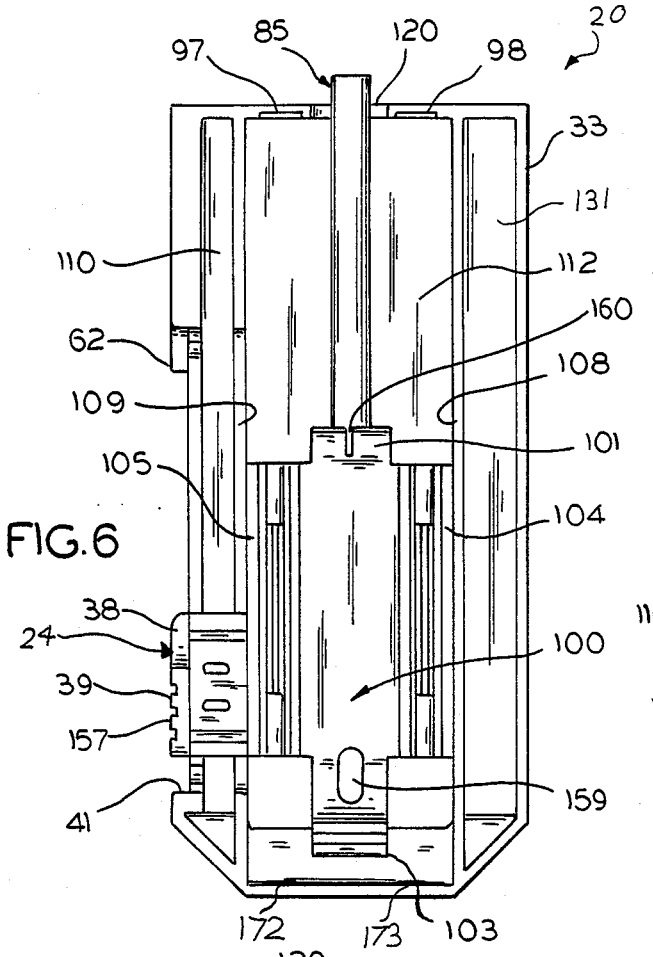
FIG. 6 of the drawings is an elevated front view of one internal side of the apparatus housing means showing the tool carriage means positioned therewithin, showing, in particular, the internal chamber of the housing means, as well as the track in which the tool carriage means is positioned for reciprocation.
Figure 9:
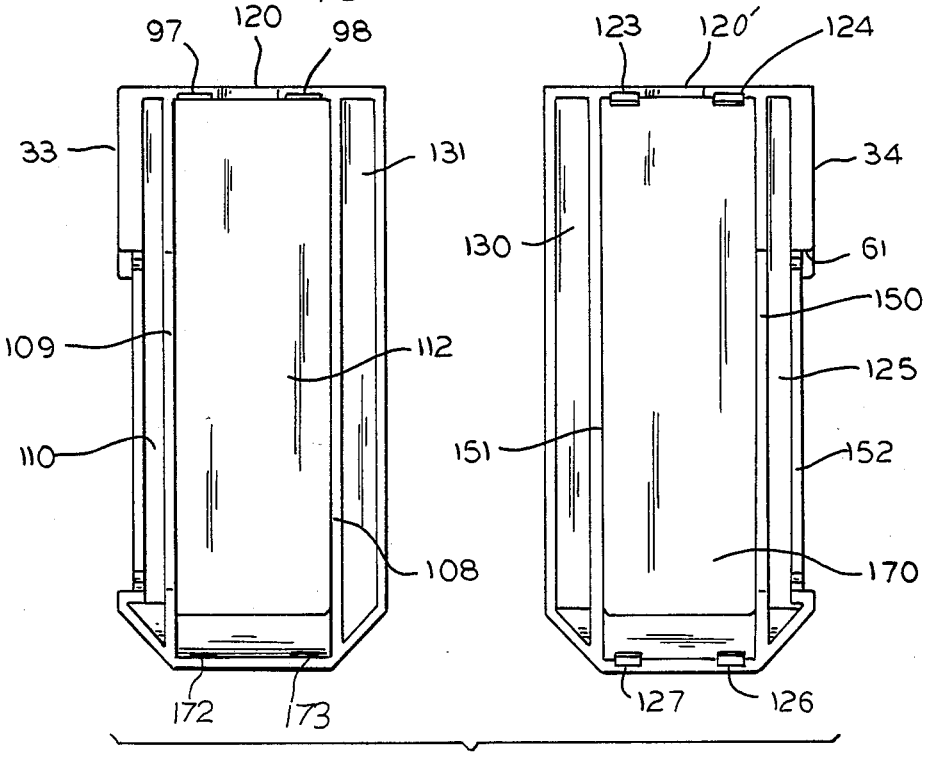
FIG. 9 of the drawings is an elevated exploded view of the interior sides of the apparatus housing means, showing, in particular, the substantially symmetrical design of both articulatable halves of the apparatus housing.

Half 33 of housing means 25 is shown in FIG. 6 after first half 34 of housing means 25, and end cap 21 have been removed. Half 33 defines internal chamber portion 112, and, when combined with the other housing half 34, and internal chamber portion 170, as shown in FIG. 9, serves to secure and enable proper guidance of tool carriage means 100 when reciprocation prompting means 24 is used to slide tool carriage means 100 between its extended and retracted positions. Tool carriage means 100 is configured with side edges 104 and 105 to abut tracking ridges 108 and 109, respectively, of half 33 of housing means 25. Furthermore, side edges 104 and 105 of tool carriage means 100 additionally abut with tracking ridges 150 and 151 of second half 34 of housing means 25, as shown in FIG. 9, when the tool containment and dispensing apparatus is completely assembled. Such abutment enables tool carriage means 100 to slidably reciprocate within internal chamber 112–170 with a limited amount of free play.

Also shown in FIG. 6 is rotary cutting tool 85 in position within tool carriage means 100. Positioning of tool 85 is accomplished by inserting it into and past flared acceptance elements 101 of tool retention means 135 and 135', (shown in FIG. 10). Tool acceptance element 101 is dimensioned slightly smaller than the diameter of the rotary cutting tool, prior to the tool's insertion. Furthermore, the acceptance point is constructed with gaps, such as gap 160, which allows the acceptance point to resiliently expand to allow for an interference fit about tool 85 upon insertion. Tool 85 is accordingly secured within tool carriage means 100 once fully inserted. The tip of the tool 85 is protected from damage when properly seated in tool tip seating means 140 (shown in FIG. 11), which is located proximate to bottom 103 of tool carriage means 100. Proper seating will thereby preclude inadvertent contact between the tool and the housing, which could otherwise cause potential damage to the tool's tip, fluting, or to the housing itself. Protection to the tip of tool 85 is additionally provided by gap 159. This gap or aperture imparts additional resiliency to the bottom area of tool carriage means 100 should the carriage means be inadvertently forced down further than intended, or should the tool be jostled within apparatus 20.

Housing aperture 120, positioned at the top of housing means 25, allows for the insertion and removal of tool 85 when tool containment and dispensing apparatus 20 is completely assembled. Accordingly, aperture 120 should be of a dimension greater than the diameter of tool 85 itself.

Second half 33 of housing means 25 also includes channels 110 and 131, as shown in FIG. 6. These channels increase the rigidity of the housing while reducing the amount of material needed to construct the apparatus. Accordingly, the overall weight and cost of the apparatus can be minimized, while simultaneously maintaining efficient structural support necessary for the reciprocation of tool carriage means 100, and reciprocation prompting means 24 therewithin. Upper clip connection points 97 and 98 are also shown at the top of second half 33 of apparatus housing 25, as well as lower clip connection point 172 and 173 located near the bottom of second half 33. Upper clip connection points 97 and 98 cooperate with clips 124 and 123, respectively, located near top of first half 34 of housing means 25, and lower clip connection points 172 and 173 cooperate with clips 126 and 127, respectively, as shown in FIG. 9, when housing 25 is fully assembled. Also shown in FIG. 6 are bottom reciprocating limit means 41, contour 62 of top reciprocating limit means 171, first half 38 of prompting means 24, and knurled portions 39 and 157 of prompting means 24.

Figure 7:
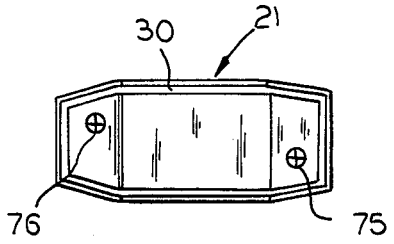
FIG. 7 of the drawings is a bottom plan view of the replaceable end cap of the tool containment and dispensing apparatus, showing, in particular, the biased detents which are used to operably secure the replaceable end cap to the top of the housing means.
Figure 8:
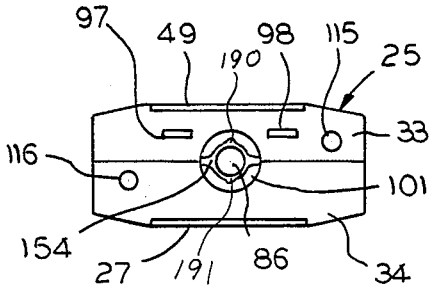
FIG. 8 of the drawings is a top plan view of the housing means of the apparatus, showing, in particular, the connection apertures for releasably receiving the detents of the end cap, the attachment means maintaining the halves of the housing together, as well as showing the positioning of the rotary cutting tool within the tool acceptance portion of the carriage means.

End cap 21 is shown in FIG. 7 as including biased detents 75 and 76 which mate with detent acceptance apertures 115 and 116, respectively, as shown in FIG. 8. Abutment edge 30 of end cap 21 is also shown.

Apparatus housing 25 is shown in FIG. 8, as is top 86 of rotary cutting tool 85. Tool 85 is shown secured within tool accepting element 101. When apparatus housing means 25 is completely articulated, clips 123 and 124, as shown in FIG. 9, cooperate with clip connection points 98 and 97, respectively. Accordingly second half 33 and first half 34 of housing means 25 will be removably secured together so that the apparatus itself will not inadvertently come apart. Furthermore, labels 27 and 49 are recessed into the surfaces of the first and second halves of the housing means, so that a relatively flush surface can be achieved. Also shown in FIG. 8 are detent accepting apertures 115 and 116, as well as gap 154 between the flanges of tool acceptance element 101.

Second half 33 and first half 34 of apparatus housing means 25 are shown in FIG. 9, prior to their assembly to one another and prior to the insertion of tool carriage means 100 therebetween, as shown in FIG. 6. Both halves of housing means 25 are substantially symmetrical. Also shown in housing half 34 are upper clips 123 and 124, and lower clips 127 and 126, and the corresponding upper connection points 97 and 98, and lower connection points 172 and 173 in housing half 33. Before the two halves are assembled to one another, tool carriage means 100 is operably positioned within the internal chamber formed therebetween, so as to be slidably secured between internal tracks 108 and 109 of half 33 and internal tracks 150 and 151 of housing half 34. Furthermore, both halves 33 and 34 incorporate channels, such as channels 110, 131, 125 and 130, respectively, which reduce the overall weight and material needed to manufacture the apparatus. Also shown in FIG. 9 are aperture halves 120 in second half 33, and 120, in first half 34.

Tool carriage means 100 is shown in an open configuration in FIG. 10 as comprising two substantially symmetrical halves, joined at their bottoms. Each half consists of side walls, such as side walls 104 and 105, and corresponding side walls 104, and 105, respectively. Upon articulation of tool carriage means 100, these side walls slidably abut with internal tracks 108, 109, 150 and 151 located in the inner chamber of apparatus housing means 25, as shown in FIG. 9. Because tool carriage means 100 is constructed of a resilient, yet rigid material, such as nylon, sliding is easily accommodated without further lubrication, and inadvertent minor shock imparted to housing 25 of the apparatus 20 will be absorbed by the tool carriage means.

Figure 11:
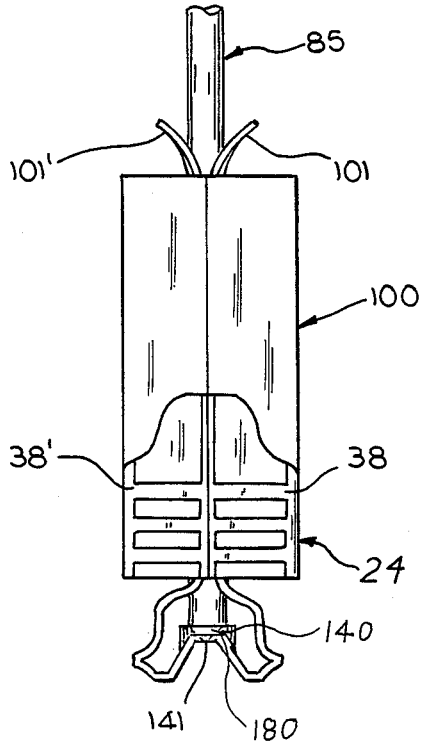
FIG. 11 of the drawings is an elevated side view of the tool carriage means fully assembled, showing the positioning of the rotary cutting tool therewithin together with the positioning of the tip of the tool seated within the tool tip seating means.

Each half of tool carriage means 100 is configured with tool positioning channels 135 and 135' extending along the longitudinal axis of each of the carriage halves. These tool positioning channels enable a secure, relatively contoured fit, around the shank portion of rotary cutting tool 85 therein, as shown in FIG. 11. Furthermore, telescopic tool acceptance elements 101 and 101' are also configured with contoured channels 190-191 which are angled up and away from the top of tool carriage means so as to efficiently accept insertion of the tip of rotary cutting tool 85, as shown in FIG. 11, for actual insertion into and maintenance by tool carriage means 100.

Hinge portion 103 and 103' enable tool carriage means 100 to be operably spread apart while remaining a single unit. The hinge is constructed to provide additional resiliency so as to protect the tool and tool cutting tip, in the event that bottom 141 is inadvertently forced against the bottom of housing means 25, as shown in FIG. 1, or if shock is imparted to the housing. Tool tip seating means 140 is positioned between hinge portion 103 and 103, When a rotary cutting tool is completely positioned within tool carriage means 100, the tool cutting tip will be seated within tool tip seating means 140. Once properly seated, the cutting tip will be protected from any inadvertent contact with other structures. Furthermore, because the cutting tip does not extend beyond tool carriage means 100, any inadvertent contact between the cutting tip and the internal chamber of the housing is precluded.

Reciprocation prompting means 24 comprises first half 38 and second half 38' when tool carriage means 100 has been assembled. First half 38 includes apertures 136 and 137, which cooperate with raised detents 138 and 139 of second half 38' thereby causing an interference fit therebetween. Accordingly, such cooperation secures tool carriage means 100 in a fully assembled position. Additionally, both halves 38–38' of reciprocation prompting means 24 include contoured lip portions, such as contoured lip portions 142, 142,, 143 and 143, Once these lip portions abut, they form a top bead and a lower bead which are then used to cooperate with locking means, such as locking means 61 and locking means 29, as shown in FIG. 1, so as to secure tool carriage means 100 into a retracted or extended position within housing means 25.

In FIG. 11, tool carriage means 100 is shown fully assembled, outside of the apparatus housing means, and further shows rotary cutting tool 85 positioned therewithin. When tool 85 is fully inserted, its cutting tip will be properly seated in tool tip seating means 140, located just above bottom portion 141. In addition, tool accepting elements 101 and 101' securely grasp the shank portion of the tool so as to eliminate inadvertent movement therebetween. Also shown in FIG. 1 are first half 38 and second half 38' of reciprocation prompting means 24.

The foregoing description and drawings merely explain and illustrate the invention and the invention is not limited thereto except insofar as the appended claims are so limited as those skilled in the art who have the disclosure before them will be able to make modifications and variations therein without departing from the scope of the invention.

What is claimed is:

1. A tool containment and dispensing apparatus for enclosing and protecting a rotary cutting tool, as well as for safely handling, storing and transporting such a rotary cutting tool, said tool containment and dispensing apparatus comprising:

housing means having an internal chamber described by a front portion and a back portion opposite said front portion, a top end and a bottom end opposite said top end, and a first side and a second side opposite said first side for accepting and enclosing said rotary cutting tool therewithin;

aperture means positioned at said top end of said housing means, said aperture means being of a size greater than the diameter of said rotary cutting tool so as to enable the insertion and removal of said rotary cutting tool through and past said aperture means, and, in turn, into and out of said internal chamber of said housing means;

tool carriage means for operable, releasable receipt and maintenance of said rotary cutting tool, said tool carriage means including a top end and a bottom end opposite said top end, and a pair of sides, and slidably positioned for operable reciprocation within said internal chamber of said housing means from an extended position proximate to said top end of said housing means to a retracted position proximate to said bottom end of said housing means, to, in turn, reorient the position of said rotary cutting tool maintained therewithin from a partially exposed extended position to a fully enclosed retracted position contained within said internal chamber of said housing means, said tool carriage means further being reciprocated substantially along the longitudinal axis of said housing means; and tool retention means operably positioned within said tool carriage means for telescopically and releasably accepting, maintaining and releasing said rotary cutting tool towards releasable maintenance of said rotary cutting tool within said tool carriage means, said tool retention means positioning said rotary cutting tool in operable alignment with said aperture means to facilitate passage of said rotary cutting tool into and out of said aperture means, and, in turn, said internal chamber, without obstruction.

2. The invention according to claim 1 in which said tool carriage means includes reciprocation prompting means operably attached to said tool carriage means for exposure on the outside of said housing means, and, in turn, outside said internal chamber, for manually prompting the slidable reciprocation of said tool carriage means, and, in turn, said rotary cutting tool between said partially exposed extended position and said fully enclosed retracted position within said internal chamber of said housing means.

3. The tool containment and dispensing apparatus according to claim 2 in which said housing means further includes slot means having an upper first end and a lower second end opposite said first end to enable said exposure of said reciprocation prompting means;

said slot means being operably positioned on at least one of said front and back portions, said top and bottom ends and said first and second sides of said housing means;

said reciprocation prompting means extending from said tool carriage means through said slot means so as to be exposed along the outer periphery of said housing means for facilitating the manual prompting or reciprocation of said tool carriage means, and, in turn, said rotary cutting tool, into its alternative partially exposed extended and fully enclosed retracted positions; and said reciprocation prompting means comprising a reciprocating dispenser switch element.

4. The invention according to claim 3 wherein said slot means further includes reciprocating limit means operably positioned in said housing means for restricting the extent of retraction and extension of said reciprocation prompting means, and, in turn, said tool carriage means, as well as said rotary cutting tool, between predetermined reciprocation limit positions;

said reciprocating limit means comprising an upper stop element operably positioned adjacent to said upper first end of said slot means; and said reciprocating limit means further comprising a lower stop element operably positioned adjacent to said lower second end of said slot means.

5. The invention according to claim 4 in which said slot means further includes, at its upper first and lower second ends, reciprocation locking means operably positioned thereat for releasably securing said tool carriage means, and, in turn, said rotary cutting tool, into its alternative partially exposed extended and enclosed retracted positions, respectively.

6. The invention according to claim 3 in which said reciprocating dispenser switch element includes a knurled surface for facilitating ease in manual manipulation of said reciprocation prompting means, and, in turn, said tool carriage means together with said rotary cutting tool, as it is reciprocated between its said alternative partially exposed extended, and said fully enclosed retracted positions.

7. The tool containment and dispensing apparatus according to claim 1 in which the invention further comprises replaceable end cap means having a top end and a bottom end opposite said top end, wherein said bottom end of said end cap means is removably attachable to said top end of said housing means for effectively covering, enclosing and protecting the rotary cutting tool positioned therewithin said housing means, said replaceable end cap means further sealing the internal chamber from foreign materials and liquids so as to further isolate and protect the rotary cutting tool within said housing means, during the handling, storage and transportation of said tool containment and dispensing apparatus.

8. The invention according to claim 7 in which said top end of said housing means further includes a plurality of end cap attachment apertures, said replaceable end cap means including mated fastening elements aligned with said attachment apertures, for facilitating the releasable securement of said replaceable end cap means to said top end of said housing means.

9. The invention according to claim 8 in which said mated fastening means of said replaceable end cap means comprises biased detents operably attached to said bottom end of said replaceable end cap means for operable alignment and cooperation with said end cap attachment apertures at said top end of said housing means, for releasable securement therebetween.

10. The invention according to claim 1 in which said housing means further includes tracking means operably positioned along the interior side of at least one of said front and back portions within said internal chamber of said housing means to effectively guide said tool carriage means during said slidable reciprocation of same, so as to facilitate aligned movement of said tool carriage means, and, in turn, to keep said rotary cutting tool maintained therewithin, operably aligned with said aperture means to in turn facilitate said passage of said rotary cutting tool into and out of said aperture means, and, in turn, into and out of said internal chamber, without obstruction.

11. The invention according to claim 1 in which said tool retention means comprises a resilient tool positioning channel means concentrically positioned within said tool carriage means for operably and releasably receiving, guiding and maintaining said rotary cutting tool in its substantially aligned position relative to said aperture at said top end of said housing means.

12. The invention according to claim 11 in which said tool retention means includes tapered acceptance edges operably positioned at said top end of said tool carriage means for facilitating the insertion of said rotary cutting tool into and out of said tool positioning channel means within said tool carriage means.

13. The invention according to claim 1 in which said tool carriage means further includes tool tip seating means operably positioned proximate to the bottom end of said tool carriage means, for effectively locating, maintaining and accordingly protecting the cutting tip of said rotary cutting tool, said tool tip seating means being resiliently positioned in said tool carriage means so as to enable the absorption of shock which may inadvertently occur between said rotary cutting tool and said tool carriage means.

14. The invention according to claim 1 in which said tool carriage means is constructed of a substantially resilient elastomeric material, said resilient material effectively absorbing shock transmitted to said rotary cutting tool while reducing friction during reciprocation of said tool carriage means within said housing means.

15. The tool containment and dispensing apparatus according to claim 7 in which the invention further includes one or more label receiving areas operably positioned along at least one exposed aligned surface of both said housing means and said replaceable end cap means for operable cooperation with one or more labels, at least one of said one or more labels being capable of attachment to at least a portion of said aligned surface of both said housing means and said replaceable end cap means so as to form a seal therebetween, and said one or more labels being scored at a position adjacent to said bottom end of said replaceable end cap means and said top end of said housing means, so as to break away at said position upon removal of said replaceable end cap means from said housing means, said one or more broken-away labels thereby indicating that said tool containment and dispensing apparatus has been unsealed.

16. The tool containment and dispensing apparatus according to claim 7 in which said invention further comprises indicia means operably and visibly affixed to at least one of said housing and replaceable end cap means, for identifying the structural specifications of a rotary cutting tool contained therewithin together with any maintenance data that may need to be associated therewith.

* * * * *